United States Patent [19]

Wilson

[11] Patent Number: 4,665,989

[45] Date of Patent: May 19, 1987

[54] WELL PRODUCTION START UP METHOD

[75] Inventor: Robert Wilson, Plano, Tex.

[73] Assignee: Atlantic Richfield Company, Los Angeles, Calif.

[21] Appl. No.: 882,659

[22] Filed: Jul. 1, 1986

[51] Int. Cl.[4] ..... E21B 36/00; E21B 43/24

[52] U.S. Cl. ..... 166/302; 166/59; 166/60; 166/263; 166/303; 166/371

[58] Field of Search ..... 166/250, 263, 302, 303, 166/371, 59, 60, 65.1, 371, 369

[56] References Cited

U.S. PATENT DOCUMENTS

| | | | |
|---|---|---|---|
| 2,018,700 | 10/1935 | Blau | 166/369 |
| 2,771,954 | 11/1956 | Jenks et al. | 166/302 |
| 2,788,855 | 4/1957 | Peterson | 166/303 |
| 2,832,416 | 4/1958 | Allen | 166/303 |
| 3,104,711 | 9/1963 | Haagensen | 166/60 |
| 3,133,592 | 5/1964 | Tomberlin | 166/60 |
| 3,324,946 | 6/1967 | Belknap | 166/303 X |
| 3,439,742 | 4/1969 | Durie | 166/303 X |
| 4,300,037 | 5/1982 | Richardson et al. | 166/303 X |
| 4,466,484 | 8/1984 | Kermabon | 166/60 |
| 4,503,910 | 3/1985 | Shu | 166/263 |

*Primary Examiner*—George A. Suchfield
*Attorney, Agent, or Firm*—Roderick W. MacDonald

[57] ABSTRACT

A method for starting up the production of hydrocarbonaceous fluid from a wellbore which has been shut-in for a time such that the ratio of water to hydrocarbon present in the hydrocarbonaceous fluid in the wellbore is sufficiently high as to make it uneconomic to produce hydrocarbonaceous fluid from said wellbore, the improvement comprising heating the reservoir around said wellbore and the hydrocarbonaceous fluid contained therein suficiently to cause the said hydrocarbonaceous fluid to be substantially less viscous and to cause at least some thermal expansion of said hydrocarbonaceous fluid whereby the water to hydrocarbon ratio is decreased to a value at which hydrocarbonaceous fluid can be economically produced from said wellbore and thereafter starting up production of hydrocarbonaceous fluid from said wellbore.

3 Claims, 2 Drawing Figures

WELL PRODUCTION START UP METHOD

BACKGROUND OF THE INVENTION

Because of the current worldwide over supply of crude oil, natural gas, and similar hydrocarbonaceous fluids, it is well known that the production of hydrocarbonaceous fluids form certain low production wells has been shut-in because it is no longer economic to produce these wells. Often, such wells are termed "stripper wells" and typically produce less than ten barrels of oil per day.

If a particular well is shut-in for a sufficient length of time, it is often not economic thereafter to start up production from that well again because of the incursion of aqueous fluids, such as salt water, during the shut-in period. When this occurs the well is cemented in and abandoned at substantial extra cost to the owners, even though there is a substantial amount of oil or other hydrocarbonaceous fluid still present in the reservoir surrounding the wellbore that is to be plugged with cement and abandoned. For example, twenty to forty percent of the pore volume of a reservoir can still contain useful hydrocarbonaceous fluid which is desirably recovered if it can be recovered economically.

Thus, even though the well was producing economic volumes of hydrocarbonaceous fluid before shut-in, after being shut-in for a substantial time period, it can be uneconomic to start up production from that well again because the water/hydrocarbon ratio of fluids produced from the reservoir into the wellbore has, during shut-in, increased to a value where so much water is pumped along with the hydrocarbon that the production costs prevent start up and continued production of the well.

However, if the water/hydrocarbon ratio of fluids present in the wellbore and reservoir could be decreased to a value which rendered the produced hydrocarbonaceous fluid economically viable, then it is better not to plug and abandon the well, but rather merely to leave it shut-in until market forces are such that start up of production of the well once again becomes economically viable.

BRIEF SUMMARY OF THE INVENTION

In accordance with this invention, a shut-in well is treated to reduce the water to hydrocarbon ratio of hydrocarbonaceous fluid produced therefrom to a value at which hydrocarbonaceous fluid can once again be economically produced from that well.

In accordance with this invention, the shut-in well is subjected to a heating treatment to heat the reservoir around the wellbore and to heat the hydrocarbonaceous fluid contained in that reservoir for a time and at a temperature sufficient to render said hydrocarbonaceous fluid substantially less viscous and to cause at least some thermal expansion of hydrocarbons in said reservoir, whereby the water to hydrocarbon ratio in said hydrocarbonaceous fluid is decreased. Heating is continued until said water to hydrocarbon ratio has decreased to a value at which hydrocarbonaceous fluid can again be economically produced from the well. Thereafter production from the thus heat treated well is started up and continued as long as desired. This way, a substantial portion of the residual hydrocarbon in said reservoir can be recovered and utilized instead of undergoing the cost of plugging and abandoning the well and the permanent loss of the residual oil and other hydrocarbon still present in the reservoir at the time the well was shut-in.

Accordingly, is an object of this invention to provide a new and improved method for starting up and producing shut-in wells. It is another object to provide a new and improved method which minimizes the need for plugging and abandoning wells which need to be shut-in temporarily for economic purposes.

Other aspects, objects and advantages of this invention will be apparent to those skilled in the art from this disclosure and the appended claims.

DETAILED DESCRIPTION

Figure 1:
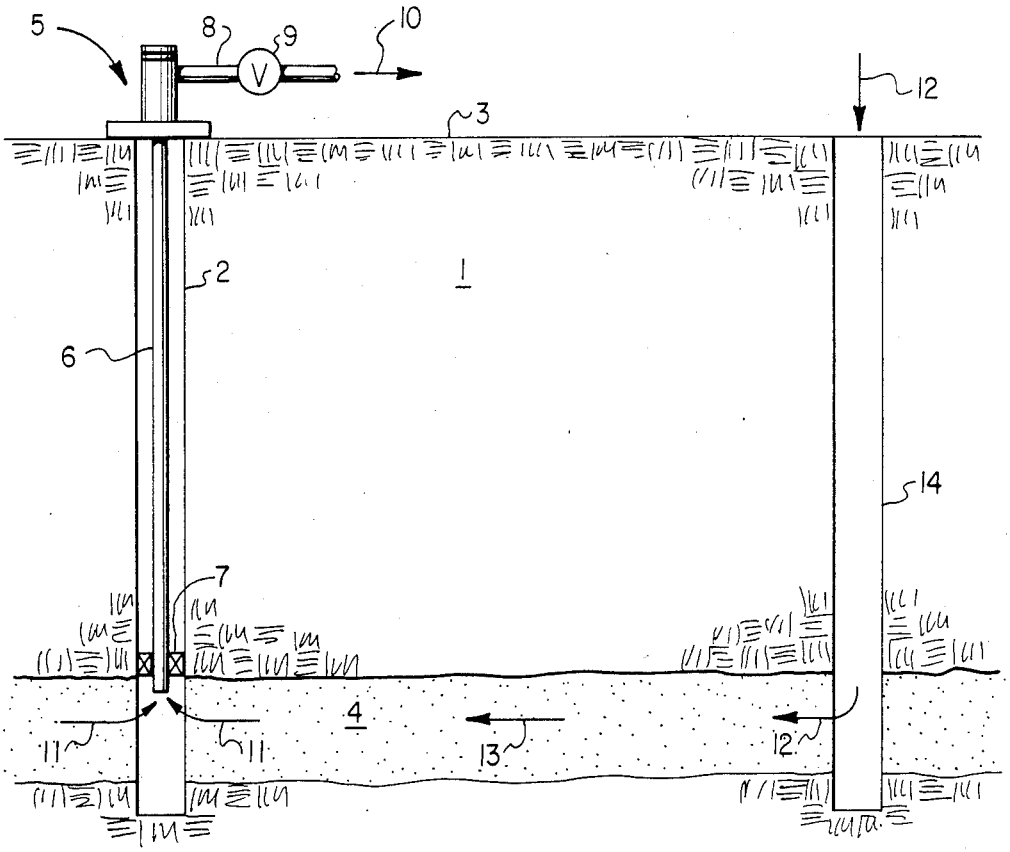
FIG. 1 shows a cross section of two wellbores in the earth and in which at least one embodiment of this invention is carried out.

FIG. 1 shows a section of the earth 1 having a wellbore 2 which extends from the surface of the earth 3 down to and througha subterranean, geologic reservoir 4 which contains hydrocarbons that are desirably produced into wellbore 2 for recovery at the earth's surface 3 in a conventional manner. Wellbore 2 is capped by a standard wellhead 5 which carries production tubing 6 that is in fluid communication with wellbore 2 below packoff 7 and in the vicinity of reservoir 4. Pipe 8 on wellhead 5 has valve means 9 and carries hydrocarbonaceous fluid 10 which is produced from reservoir 4 as shown by arrows 11 for recovery and other disposition on earth's surface 3.

Produced hydrocarbonaceous fluid 11 often contains not only hydrocarbon materials such as crude oil, natural gas, and the like, but also aqueous fluid such as salt water. When wellbore 2 was initially drilled and reservoir 4 contained a large amount of hydrocarbon, the water/hydrocarbon ratio of fluids produced into wellbore 2 and recovered at the earth's surface was very low but over the years as more and more hydrocarbonaceous fluid is recovered at the earth's surface and the amount of hydrocarbon in reservoir 4 gradually depleted, aqueous fluid such as salt water can creep into reservoir 4 and be produced along with hydrocarbons into wellbore 2 so that the water/hydrocarbon ratio increases over the years during which the well is produced.

If wellbore 2 is shut-in by simply closing valve 9 so that no more hydrocarbonaceous fluid flows into tubing 6, aqueous fluid intrusion into reservoir 4 can still proceed even though the well is shut-in so that if the well is later started up by opening valve 9, the hydrocarbonaceous fluid 10 recovered at the earth's surface can have a substantially increased water to hydrocarbon ratio over what that ratio was when the well was shut-in the first place, thereby making it uneconomic to start up the well.

In such a situation, the net result is removal of wellhead 5, tubing 6, and packoff 7, and filling wellbore 2 with cement thereby plugging and abandoning the well. Not only is this procedure expensive, but also it leaves whatever residual hydrocarbon that was still in reservoir 4 permanently lost unless a new and expensive well is drilled into reservoir 4.

Even though wellbore 2 has been shut-in for a time such that the water to hydrocarbon ratio of the hydrocarbonaceous fluid 11 present in reservoir 4 has increased to a value such that it would be uneconomic to start up production of fluid 11 again because it would be primarily the production of a large amount of water and a small amount of hydrocarbon, in accordance with this invention the water to hydrocarbon ratio is decreased to a value where it would be economic to start up production of hydrocarbonaceous fluid 11 from reservoir 4 and to continue that production until a substantial amount of the residual hydrocarbon present in reservoir 4 at the time of shut-in of the well is recovered. This is accomplished by heating reservoir 4 around wellbore 2 and the hydrocarbonaceous fluid 11 contained in reservoir 4 around wellbore 2 for a time and to a temperature sufficient to render the hydrocarbons in reservoir 4 and in said hydrocarbonaceous fluid 11 substantially less viscous and to cause at least some thermal expansion of the hydrocarbons in reservoir 4. By substantially lowering the viscosity of the hydrocarbons present and mobilizing additional hydrocarbon by thermal expansion, the water to hydrocarbon ratio in the hydrocarbonaceous fluid 11 can be decreased substantially. In accordance with this invention, this heat treatment is continued until the water to hydrocarbon ratio of hydrocarbonaceous fluid 11 has decreased to a value at which it is again economic to produce hydrocarbonaceous fluid 11 to the earth's surface in the manner described hereinabove. When the water to hydrocarbon ratio has been decreased to an economic value in accordance with the heat treating step of this invention, production of hydrocarbonaceous fluid 11 form wellbore 2 to earth's surface 3 is started up and continued for as long as desired.

The heating step of this invention can be carried out in any conventional manner such as by employing a conventional downhole natural gas fired heater in wellbore 2, pumping steam or other heated fluid down wellbore 2 and into reservoir 4, e.g., by way of production tubing 6, employing a downhole microwave heating device in wellbore 2 or any other means for transferring heat from wellbore 2 into reservoir 4. The heat can be generated in situ in the wellbore and/or generated at the earth's surface 3 and then conducted to reservoir 4, the ultimate result desired being that a substantial portion of reservoir 4 around wellbore 2 is heated with the consequent heating of hydrocarbons and hydrocarbonaceous fluid still contained in reservoir 4 in the vicinity of wellbore 2. The magnitude and duration of heating in accordance with this invention will vary widely because of the widely varying chemical composition of various reservoirs and hydrocarbonaceous fluids therein, as well as widely varying physical characteristics of reservoirs and wellbores. Accordingly, strict quantification of the parameters for the heating step of this invention is difficult, but is not necessary to one skilled in the art so long as the heating step is carried out at a temperature and for a duration sufficient to reduce the water to hydrocarbon ratio of the hydrocarbonaceous fluid to a value at which start up of production of hydrocarbonaceous fluid is economic udner the then prevailing market conditions. Because of every changing market conditions, it is also difficult to quantify the water to hydrocarbon ratio value at which start up can begin. However, generally, the heating step of this invention can be carried out by applying to reservoir 4 a temperature of at least about 220 degrees F. for at least about 600 hours and sufficient to decrease the water to hydrocarbon ratio to a value below about 6.

The heating step of this invention can be terminated at or before start up of production of hydrocarbonaceous fluid 11 or can be continued after start up of such production if desired and continued during production as long as desired and/or economically feasible.

As will be obvious to those skilled in the art, the method of this invention is particularly useful in reservoirs which have lost any natural gas or other natural pressurization and/or which contain viscous crude oil, tar, bituman, and the like. This is so because the heating step of this invention can decrease the viscosity of the viscous hydrocarbon to the point where it it sufficiently mobile to compete with the aqueous fluid present in the reservoir and flow into the wellbore at least as fast as the water, thereby substantially improving the water to hydrocarbon ratio of the produced hydrocarbonaceous fluid. Further, the reduction in viscosity of the hydrocarbon will be much faster than the reduction in viscosity of the already more mobile aqueous fluid so that a significant increase in mobility of hydrocarbon in reservoir 4 can be achieved as evidenced by a substantial decrease in the water to hydrocarbon ratio of the hydrocarbonaceous fluid produced from reservoir. This improvement can often be achieved in a sufficiently short time period to make it economic to incur the expense of heating the reservoir and its contained hydrocarbonaceous fluid prior to start up of production.

This invention can be applied to any shut-in well so that it is not limited to the start up shut-in stripper wells. However, it is advantageously employed to stripper wells. Further, this invention is not limited to a single production well as just described with reference to FIG. 1. This invention can be applied to a system of production and/or injection wells as is commonly employed in secondary intertiary recovery processes and techniques.

For example, referring to FIG. 1, a second wellbore 14 spaced from wellbore 2 and containing similar wellhead, tubing, and pack off apparatus as shown for wellbore 2 can be employed, although, for sake of simplicity and clarity, not shown for wellbore 14. Well 14 can be used as an injection wellbore whereby a fluid such as water, steam, natural gas, and the like can be injected into reservoir 4 as shown by arrows 12. This way pressure can be increased in reservoir 4 to force hydrocarbonaceous fluid 11 in reservoir 4 and between wellbores 2 and 14 toward wellbore 2 as indicated by arrow 13. This enhances the recovery of residual hydrocarbon present in reservoir 4 when production of hydrocarbonaceous fluid 11 from wellbore 2 is again started up.

As is known to those skilled in the art, reservoir 4 is composed of rock or other material which contain a multitude of interconnected pores, the hydrocarbon, water, and other hydrocarbonaceous aqueous fluids present in reservoir 4 being contained in and conducted by such pore system. Often when a reservoir has been produced for a number of years so that only about twenty to forty percent of the pore space in the reservoir still contains hydrocarbon, a significant amount of this residual hydrocarbon is trapped in dead end or otherwise restricted pores so that it is difficult to recover. This is why secondary and tertiary recovery processes are employed.

Figure 2:
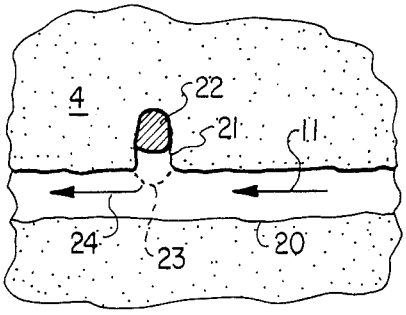
FIG. 2 shows an enlarged cross section of a pore and branch of that pore which exists in a reservoir which contains hydrocarbons.

FIG. 2 shows a main pore 20 with a dead end branching pore 21 which contains a volume of residual hydrocarbon 22 that is difficult to recover because of the capillary forces acting on hydrocarbon 22 to keep it in pore 21 due to the very small diameter of branch pore 21. However, if the reservoir rock through which pores 20 and 21 extend is heated in accordance with this invention to an extent sufficient to cause thermal expansion of hydrocarbon 22, that hydrocarbon can expand into pore 20 as shown by dotted line 23 and thereby become recoverable by being swept up by other hydrocarbonaceous fluid 11 flowing through pore 20 towards wellbore 2. This way an enrichead hydrocarbonaceous fluid 24 is produced by mixing natural hydrocarbonaceous fluid 11 with hydrocarbon 22 fter it has been thermally expanded to the point shown by dotted line 23. Thus it can be seen that by the practice of the invention, the water to hydrocarbon ratio of hydrocarbonaceous fluid 11 can be enriched with additional residual hydrocarbon to decrease the water to hydrocarbon ratio to a value at which it is once again economic to start up the production of hydrocarbonaceous fluid from wellbore 2.

EXAMPLE I

A well equipped substantially as shown for wellbore 2 is completed in a crude oil producing reservoir 4 which is essentially devoid of natural gas or other natural pressurization and, before shut-in, has a water/oil ratio of about 13. After the well is shut-in by closure of valve 9 and left shut-in for about one year, because of the incursion of salt water from above and below reservoir 4 the water to oil ratio of the hydrocarbonaceous fluid 11 available to flow into wellbore 2 is increased to at least 20. At this oil to water ratio, it is uneconomic to start up production of hydrocarbonaceous fluid from wellbore 2 and the only apparent alternative is to remove wellhed 5, tubing 6, and packoff 7 and fill wellbore 2 with cement. However, by employing a downhole natural gas fired heater below the bottom of tubing 6 in the vicinity of reservoir 4, and heating reservoir 4 at a temperature of at least about 230 degrees F. for 600 hours, the residual oil present in reservoir 4 has been reduced in its viscosity and thermally expanded in the mode explained for FIG. 2 to an extent such that the hydrocarbonaceous fluid 11 has been enriched with more mobile hydrocarbon and additional hydrocarbon so that the water to oil ratio is decreased below 6, thereby making it economic to once again start up production of hydrocarbonaceous fluid from wellbore 2 by opening valve 9 and pumping hydrocarbonaceous fluid from wellbore 2.

EXAMPLE II

An oil and water bearing formation such as reservoir 4 has a water saturation at time of shut-in of fifty-five percent, an oil saturation at time of shut-in of forty-five percent, a residual oil saturation of forty-three percent, a natural reservoir temperature of 75 degrees F., an oil viscosity of 80 centipoise, and a water viscosity of 1 centipoise. By heating the formation at 220 degrees F. for a time sufficient to reduce the oil viscosity to 9 centipoise the following is obtained:

| Temperature degrees F. | Viscosity (cp) oil | Viscosity (cp) water | Residual Oil Saturation Percent |
|---|---|---|---|
| 75 | 80 | 1 | 43 |
| 220 | 9 | 0.27 | 28 |

The viscosity reduction of the oil is essentially independent of the type of oil present in the formation.

The permeability of the formation as to residual oil ($K_{ro}$) is thirty percent and the permeability as to residual water ($K_{rw}$) is five percent and these values do not change appreciably with temperature.

The Mobility Ratio (MR) of the system is:

$$\frac{K_{ro} \times \text{viscosity of water}}{K_{rw} \times \text{viscosity of oil}}$$

This is the oil/water production ratio.

At 75 degrees F. the MR is $$\frac{30 \times 1}{5 \times 80} = 0.075.$$

At 220 degrees F. the MR is $$\frac{30 \times 0.27}{9 \times 9} = 0.100.$$

Therefore, the oil/water production ratio is $0.1/0.075=1.33$, which shows a thirty-three percent improvement in oil productivity.

In addition to the foregoing oil productivity improvement, there is an improvement in the total mobility of the system (TM). TM is equal to:

$$\frac{K_{ro}}{\text{viscosity of oil}} + \frac{K_{rw}}{\text{viscosity of water}}.$$

At 75 degrees F. the TM is $(30/80)+(5/1)=0.375+5=5.375$.

At 220 degrees F. the TM is $30/9+5/0.27=3.333+18.519=21.852$.

The corresponding water to oil ratio (WOR) is:

at 75 degrees F., $5/0.375=13.333$ which yields a pertent water cut $(13.333)/(1+13.333)$ of ninety-three percent; and at 220 degrees F., $18.519/3.333=5.56$ which yields a reduced percent water cut of eighty-five percent.

Accordingly, as a consequence of the 220 degrees F. heating step the water cut is reduced from ninety-three percent to eighty-five percent while also reducing the residual oil in the formation from forty-three percent to twenty-eight percent, both being substantial improvements in the overall productivity of the well system. Put another way, incremental recovery from this heating step can be shown as changing from two percent (45% shut-in oil saturation minus 43% residual oil saturation at 75 degrees F.) to seventeen percent (45% shut-in oil saturation minus 28% residual oil saturation at 220 degrees F.).

Therefore, for each 145 degrees F. of incremental heating the viscosity of the oil could be reduced by about a factor of ten, independent of the gravity of the oil. For a formation with permeability of one darcy, ten feet thick, and a 50 psig. pressure gradient to a wellbore which is draining a five acre area, the comparative oil production rates are:

| Reservoir Temperature Degrees F. | Well Condition | Production Rate, Barrells Per Day: Total oil Plus Water | Production Rate, Barrells Per Day: Net Total Oil |
|---|---|---|---|
| 75 | Before shut-in | 100 | 7.0 |

-continued

| Reservoir Temperature Degrees F. | Well Condition | Production Rate, Barrells Per Day: Total oil Plus Water | Production Rate, Barrells Per Day: Net Total Oil |
|---|---|---|---|
| 75 | After shut-in | 100 | 4.8 |
| 220 | After shut-in and after heating for 600 days | 407 | 61.0* |

*With no reduction of permeability of the formation. If the permeability of the formation is reduced during heating this value could be lower due to increased pore pressure.

Reasonable variations and modifications are possible within the scope of this disclosure without departing from the spirit of this invention.

I claim:

1. In a method for starting up the production of hydrocarbonaceous fluid from a wellbore in a reservoir that produces both aqueous and hydrocarbonaceous fluids and that has been shut-in for a time such that the water to hydrocarbon ratio of fluids produced from said reservoir into said wellbore has increased to a value that is not economic for start up and further production of hydrocarbonaceous fluid from said wellbore, the improvement comprising heating said reservoir around said wellbore and the hydrocarbonaceous fluid contained therein for at least about 600 hours and to a temperature of at least about 220° F. and sufficient to render the hydrocarbons in said reservoir and said hydrocarbonaceous fluid substantially less viscous and to cause at least some thermal expansion of said hydrocarbons, whereby the water to hydrocarbon ratio is decreased to a value below about 6 before starting up production of said hydrocarbonaceous fluid, continuing said heating until said water to hydrocarbon ratio has decreased to a value at which hydrocarbonaceous fluid can be economically produced therefrom, thereafter starting up production of hydrocarbonaceous fluid from said wellbore, and continuing production of hydrocarbonaceous from said wellbore.

2. The method of claim 1 wherein said heating is terminated at or before starting up production of said hydrocarbonaceous fluid.

3. The method of claim 1 wherein said heating is continued after starting up production of said hydrocarbonaceous fluid.

* * * * *